United States Patent [19]

Backman

[11] 4,434,600

[45] Mar. 6, 1984

[54] METHOD FOR FIXING THE ENDS OF CONCRETE COLUMNS IN CONCRETE BASES AND DEVICE FOR CARRYING OUT SAID METHOD

[76] Inventor: Henrik A. Backman, Bovägen 6, S-18143 Lidingö, Sweden

[21] Appl. No.: 251,318

[22] Filed: Apr. 6, 1981

[30] Foreign Application Priority Data

Apr. 10, 1980 [SE] Sweden ..... 8002718

[51] Int. Cl.[3] ..... E02D 27/00

[52] U.S. Cl. ..... 52/741; 52/169.13; 52/296; 52/742

[58] Field of Search ..... 52/741, 742, 169.13, 52/170, 294, 295, 296, 297, 298, 514; 405/216, 231

[56] References Cited

U.S. PATENT DOCUMENTS

| | | | |
|---|---|---|---|
| 878,230 | 2/1908 | Orr | 52/295 |
| 1,544,863 | 7/1925 | Ross . | |
| 1,667,970 | 5/1928 | Herrmann | 52/170 |
| 1,679,297 | 7/1928 | Ehrler | 52/742 |
| 1,723,376 | 8/1929 | Rutherford . | |
| 1,874,359 | 8/1930 | Rutherford . | |
| 2,685,194 | 8/1954 | Amiriklan | 52/295 |
| 2,948,995 | 8/1960 | Cogan | 52/295 |

FOREIGN PATENT DOCUMENTS

| | | | |
|---|---|---|---|
| 465358 | 5/1950 | Canada | 405/216 |
| 219383 | 2/1910 | Fed. Rep. of Germany . | |
| 192343 | 11/1964 | Sweden | 52/294 |
| 408077 | 5/1979 | Sweden . | |
| 24857 | of 1910 | United Kingdom | 52/295 |

*Primary Examiner*—Henry E. Raduazo
*Attorney, Agent, or Firm*—Bucknam and Archer

[57] ABSTRACT

The invention relates to a method and device for fixing columns in concrete bases. The device is a framed structure which forms a steel basket which is embedded in the concrete base and in which a column is mounted, aligned, wedged underneath and on the sides prior to placing concrete around the column.

6 Claims, 8 Drawing Figures

Figure 3:
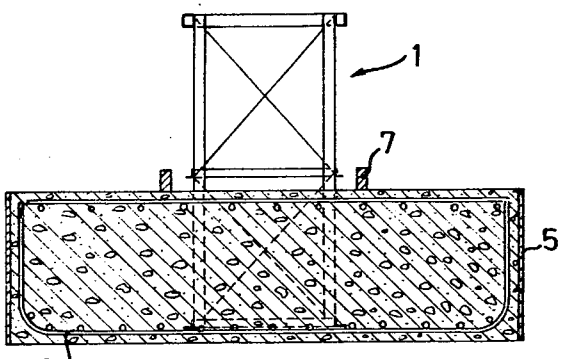

METHOD FOR FIXING THE ENDS OF CONCRETE COLUMNS IN CONCRETE BASES AND DEVICE FOR CARRYING OUT SAID METHOD

The present invention relates to a method of fixing the ends of concrete columns in footing and foundation bases of concrete, in which method the base is first cast in a form, the column then being inserted down into a construction embedded in the base and extending upwards from the upper surface of the base, said column then being embedded in said construction.

Previously, for fixing the ends of columns to concrete bases, a trough or box of reinforced concrete has been cast on top of the base. After underfilling and side-wedging of the column in the box, the space between the column and the inner walls of the box was filled with concrete. When using this method, loose reinforcing rods for the box must be mounted and wire-braced to the reinforcement of the base before the base can be cast. After the base is cast, an inner form and an outer form for the box are assembled, and the box can then be cast. Only after the concrete has hardened and the inner form has been removed, can the column be put in place.

This method is both time-consuming and laborious and makes great demands on the skill of the workers. The reinforcing work is time-consuming since the reinforcement is made of loose rods, and the waiting time is long, since the reinforcement alone cannot take the loads and therefore one must wait some time after the casting until the concrete has cured and the column can be mounted. Before mounting, the inner form must be dismantled, and this is relatively difficult. Finally, underfilling the column is complicated, since the column box prevents access from the side.

The purpose of the present invention is to achieve a time and work-saving method of fixing the ends of columns in concrete bases, which also requires less professional skill.

This is achieved according to the invention by said construction extending upwards from the upper surface of the base and consisting of a steel basket, which is placed in the form for the base and is embedded in the base when the base is cast, and in which basket the column is placed, side-wedged and underfilled prior to casting around the column in a form surrounding the steel basket.

To carry out the method, according to the invention a framed steel reinforcing structure is used which is made as a separate unit and which has one portion which is to be embedded in the concrete base and another portion intended to extend above the base, forming side supports for the column when it is mounted and side-wedged.

The method and device according to the invention save considerable time and work. The steel basket forms a separate reinforcement structure, which can be manufactured in workshops as a finished unit, thus eliminating time-consuming reinforcing work on the building site. By virtue of the fact that the basket can take loads without concrete and the column can thus be placed directly in the basket, this simplifies the underfilling, since this work can be done from the side. Furthermore the need for an inner form is eliminated. Finally no complicated stays are required on the outer form, since it can be bolted directly to the basket.

Figure 4:
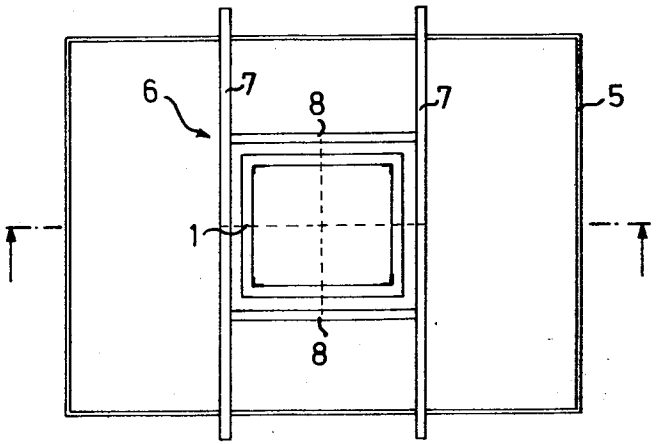
Figure 2:
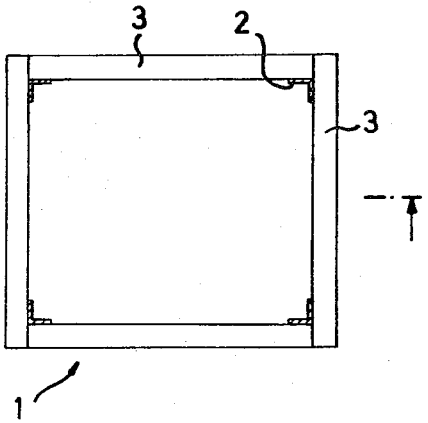
Figure 1:
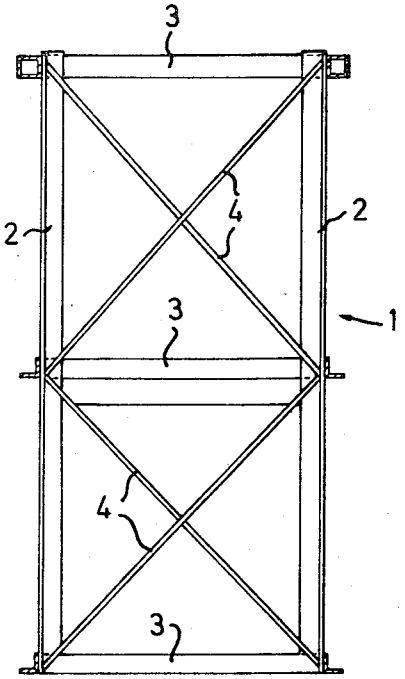
Figure 7:
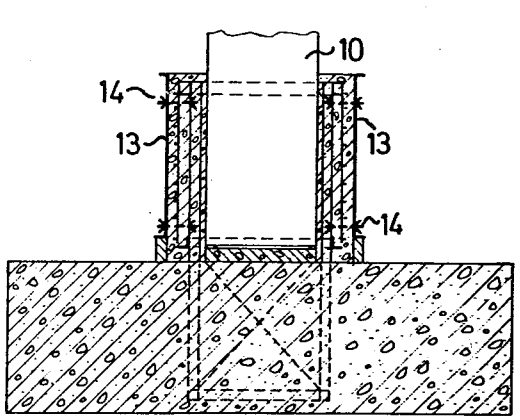
Figure 8:
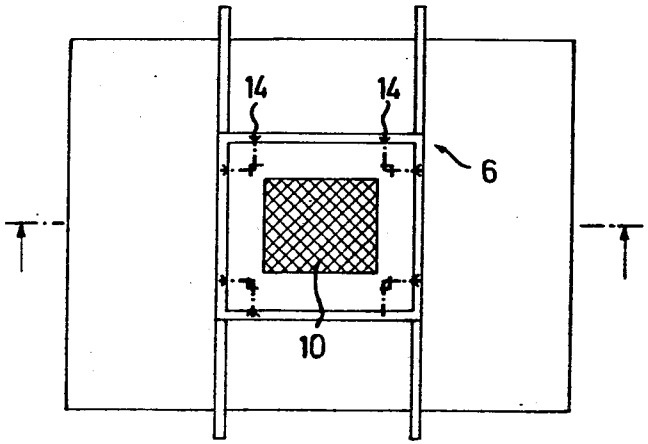
Figure 5:
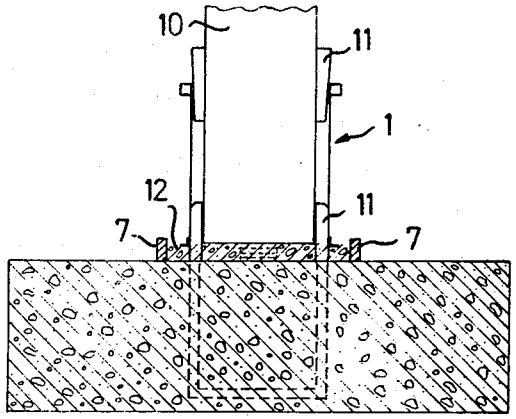
Figure 6:
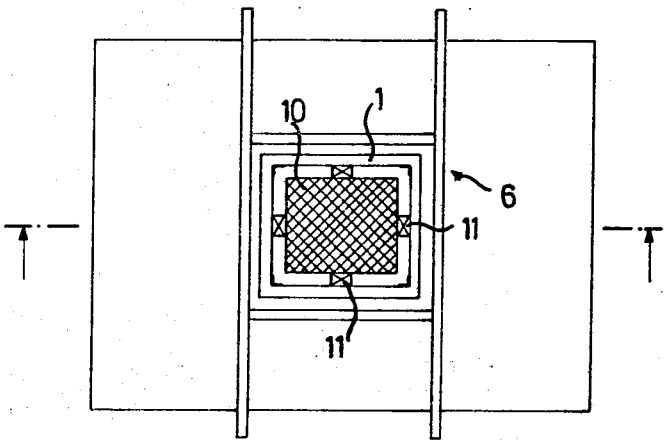

The invention will be described in more detail here with reference to the accompanying drawings showing an embodiment, in which FIGS. 1 and 2 shows a side view and a plane view respectively of a steel basket according to the invention, FIGS. 3 and 4 show a side view and a plane view respectively of the basket in FIGS. 1 and 2 placed in a base form, FIGS. 5 and 6 show views corresponding to those in FIGS. 3 and 4 with a column in place, and FIGS. 7 and 8 shows views corresponding to those in FIGS. 5 and 6 after concrete has been cast around the column.

FIGS. 1 and 2 show a steel basket 1, which forms a self-supporting reinforcement for a so-called column box and consists of a number of L-profiles 2 and 3 and cross stays 4 welded or bolted together.

When applying the method according to the invention for fixing a column in a footing base or foundation base, the form and reinforcement of the base are arranged in the usual manner (FIGS. 3 and 4). A fixing frame 6 is mounted on the base form 5 and is fixed in position. The frame has a pair of beams 7 which rest on the form 5, and a pair of beams 8 which, together with the beams 7, define a square space within which the column is to be mounted. FIG. 4 shows with dashed lines a wire cross which is used when putting the frame 6 in place for sighting against a reference mark. The wires are cut after the frame is in place. In the next step the steel basket 1 is lowered through the frame 6 and is braced with wires to the base reinforcement 9. Furthermore the basket is fixed to the frame 6 in a manner not shown in more detail here. The base can then be cast.

When the base has hardened, a column 10 can be mounted directly in the steel basket 1 which is now embedded, as illustrated in FIGS. 5 and 6. The level of the top of the column is adjusted by means of wedges (not shown) placed under the column. The column is adjusted laterally by driving wedges 11 between the basket and the column. Concrete is then placed under the column within the fixing frame which remains in place, as indicated at 12.

After mounting welded mesh reinforcement around the steel basket 1, form sides 13 are mounted making an outer form (FIGS. 7 and 8). The sides of the form 13 are fixed to the basket by means of bolts 14 and the form is filled with concrete thus surrounding the column 10. The form can remain in place or be of a removable type made of sheet steel. After the cutting-off of the beams 7 of the frame and possibly dismantling the outer form, the work is complete.

Thus by using a "self-supporting reinforcement" which can take loads, the invention has substantially simplified the fixing of columns in concrete bases in comparison to known methods.

What I claim is:

1. A method of fixing the end of a concrete column in a footing base of concrete which comprises the steps of positioning a steel basket into a first form for casting the footing base; pouring concrete into said first form to cast such base with a portion of the steel basket extending thereabove and a portion of the steel basket extending therebelow and embedded in the concrete of said base; positioning the end of the concrete column into the portion of the steel basket extending above said base; positioning a second form about said portion of the steel basket above the base; and pouring concrete into said second form to cast a concrete sheath around said portion of the steel basket and end of the column above the base, said concrete sheath being thereby integrally bonded to the end of the concrete column and to said base.

2. A method according to claim 1 wherein the end of said concrete column is positioned a predetermined spacing distance above the surface of said base and the end of the concrete column is bonded to said base surface by concrete introduced into said spacing.

3. A method according to claim 1 including the step of side-wedging said column in the steel basket prior to casting said concrete sheath.

4. A method according to claim 1 including the steps of placing a fixing frame for said basket on the upper portion of said first form, said fixing frame being secured to said first form before the basket is emplaced; and lowering the basket into said first form through the fixing frame; securing the basket to the fixing frame and to reinforcement material at the bottom of said first form prior to filling same with concrete.

5. A method according to claim 4 wherein said fixing frame is used as a form to retain in position, concrete placed under said column.

6. A method according to claim 1 including the step of mounting welded mesh reinforcement around said steel basket prior to casting said concrete sheath.

* * * * *